United States Patent [19]

Labrum

[11] 4,210,955

[45] Jul. 1, 1980

[54] SHUTTER SYSTEM FOR STAGE-LIGHTING SPOTLIGHTS

[75] Inventor: Joseph H. Labrum, West Jordan, Utah

[73] Assignee: Electro Controls Inc., Salt Lake City, Utah

[21] Appl. No.: 944,084

[22] Filed: Sep. 20, 1978

Related U.S. Application Data

[63] Continuation of Ser. No. 777,448, Mar. 14, 1977, abandoned.

[51] Int. Cl.[2] ..... F21V 17/02

[52] U.S. Cl. ..... 362/321; 362/264

[58] Field of Search ..... 362/321, 319, 126, 281-283, 362/264, 394, 365, 373

[56] References Cited

U.S. PATENT DOCUMENTS

| | | | |
|---|---|---|---|
| 2,076,240 | 4/1937 | Levy | 362/281 |
| 2,623,934 | 12/1952 | DeBow et al. | 362/281 |
| 2,950,382 | 8/1960 | Hatch | 362/281 |
| 3,116,022 | 12/1963 | Davis | 362/294 |
| 3,307,028 | 2/1967 | Bentham | 362/281 |
| 3,571,588 | 3/1971 | Hilzen | 362/294 |
| 3,639,751 | 2/1972 | Pichel | 362/294 |

*Primary Examiner*—Harold J. Tudor

*Attorney, Agent, or Firm*—Mallinckrodt & Mallinckrodt

[57] ABSTRACT

A shutter system for stage-lighting spotlights includes a housing having a fixed framing gate therein which has an opening therethrough for the passage of light. Two sets of opposing shutter blades are sandwiched, one on each side of the framing gate, between the framing gate and one of a pair of pressure plates which have means urging them toward the framing gate. Each shutter blade has a neck portion which extends through a slot in the housing and which serves as a handle to which pressure may be applied to move the shutter blade. The blades are normally held in place by the action of the pressure plates against the blades and framing gate.

10 Claims, 4 Drawing Figures

SHUTTER SYSTEM FOR STAGE-LIGHTING SPOTLIGHTS

RELATED APPLICATIONS

This is a continuation of application Ser. No. 777,448, filed Mar. 14, 1977, now abandoned.

BACKGROUND OF THE INVENTION

1. Field:

The invention is in the field of shutter systems for use with light sources, particularly stage-lighting spotlights, whereby the size and shape of a light beam projected by the light source may be varied.

2. State of the Art:

Present shutter systems generally have shutter blades secured to a housing in such a way that they may be pivoted about a point of securement to extend various distances into an opening to block portions of the opening. This type of shutter system is satisfactory where it is desired to merely enlarge or reduce the size of an opening in a preset manner. However, with present systems it is very difficult to vary the shape of the opening along with size. There are also problems in present systems of severe heating of the shutter blades which cause them to warp and make movement difficult.

SUMMARY OF THE INVENTION

According to the invention, a shutter system particularly adapted for use with stage-lighting spotlights includes two sets of opposing shutter blades. Each set of shutter blades is sandwiched between one of a pair of pressure plates and one side of a framing gate. The pressure plates are located on opposite lateral sides of the framing gate. Means are provided to urge the pressure plates toward the framing gate so that the shutter blades are held securely against the framing gate.

The framing gate has an opening therein to allow light to pass therethrough and the shutter blades are adapted to be moved into and out of the opening to restrict the opening to any desired size. The pressure plates have openings therein corresponding to that in the framing gate and at least as large as the opening in the framing gate.

A housing is provided to securely hold the framing gate. A set of opposing slots is provided in the housing on both sides of the framing gate. Each set of shutter blades is associated with a set of slots. Each shutter blade has a neck portion which extends through a slot and which serves as a handle to which pressure may be applied to move the shutter blade in relation to the opening in the framing gate.

Generally, each set of shutter blades will be made up of two blades arranged oppositely to each other and each set of slots will be made up of two slots arranged oppositely to each other. In this way, the shutter blades of each set are moved toward one another to cover portions of the framing gate opening. One set of slots and shutter blades will be rotated 90° from the other set so that the shutter blades can be moved into the framing gate opening from four directions.

The framing gate, pressure plates, shutter blades, and housing are made of a heat conducting material such as aluminum so that heat that may build up in the shutter blades when they are positioned in the framing gate opening blocking a portion of the light beam passing therethrough, will be conducted to the other portions of the system, particularly the housing, which acts as a heat sink surface, thereby preventing excessive heating or resultant warpage of the shutter blades. The heat transfer is promoted by the intimate contact between the framing gate, shutter blades, and pressure plates.

THE DRAWINGS

In the accompanying drawings which represent the best mode presently contemplated of carrying out the invention, FIG. 1 is a side elevation of a portion of a stage-lighting spotlight incorporating the present invention;

FIG. 2, a vertical section taken on the line 2—2 of FIG. 1;

FIG. 3, a vertical section similar to FIG. 2, showing the shutter blades in a different position; and FIG. 4, a horizontal section taken on the line 4—4 of FIG. 2 and drawn to a slightly larger scale.

DETAILED DESCRIPTION OF THE ILLUSTRATED EMBODIMENT

Figure 2:
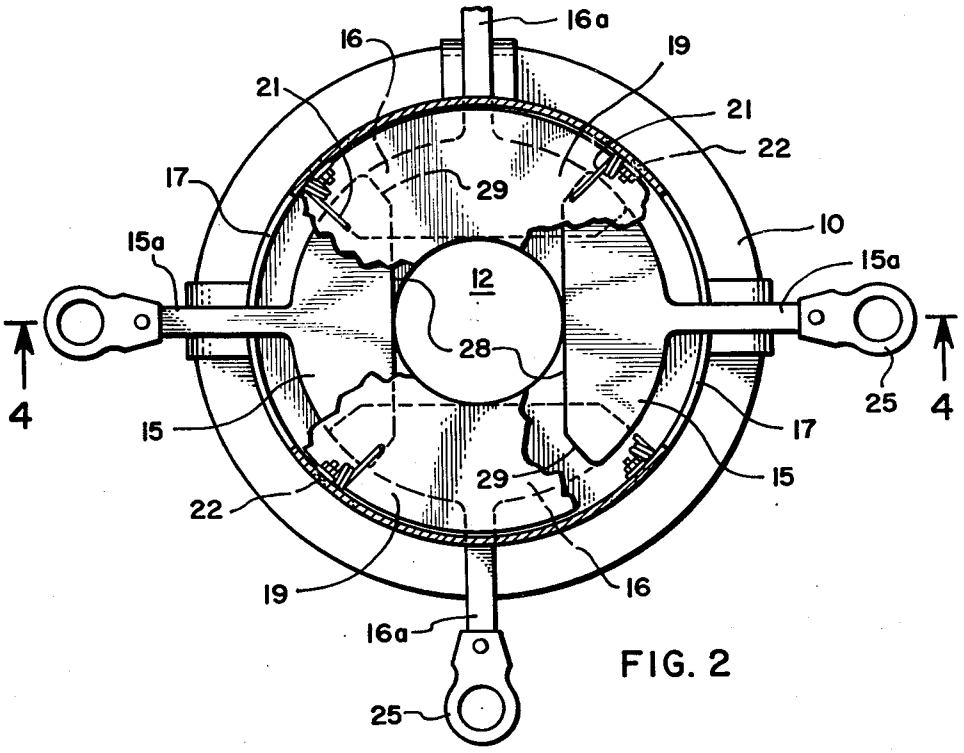
Figure 4:
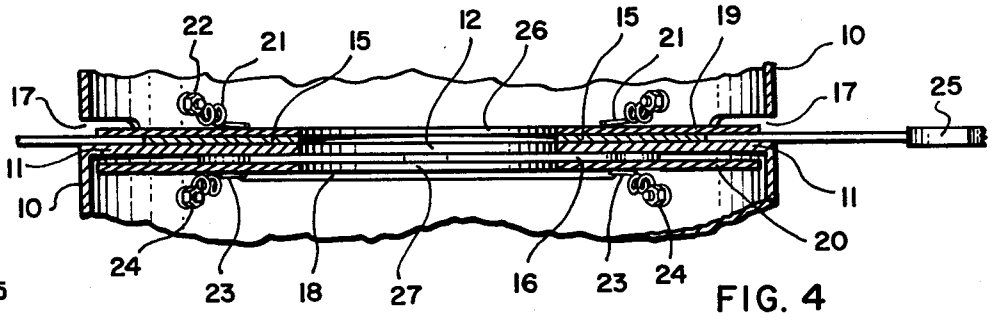
Figure 1:
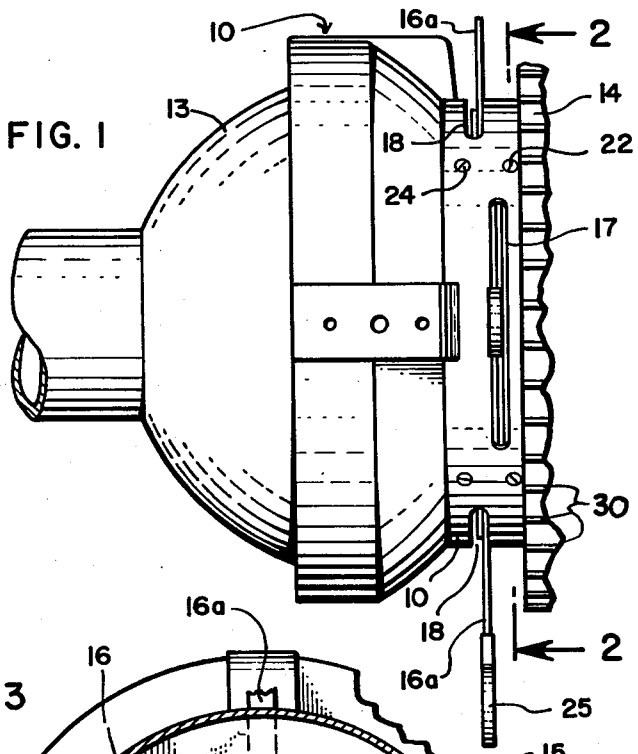

As illustrated, a stage-lighting spotlight has an annular central support housing 10 which has framing gate 11 as an integral part thereof. An opening 12 is provided in the framing gate to allow light to pass therethrough. The framing gate 11 is located between a light source and reflector unit (not shown) which is positioned and supported by a rear support housing 13 attached to central support housing 10, see FIG. 1., and a lens system (not shown) located and supported by a forward support housing 14 which is shown broken off in FIG. 1 at the point where it is attached to central support housing 10. The lens system is located in the portion of the housing 14 that extends to the right in FIG. 1, and focuses the light beam passing through framing gate opening 12. The light source and reflector, the framing gate, and the lens system are all conventional components of standard stage-lighting spotlights.

A set of shutter blades, shown as a pair of opposing shutter blades 15, is positioned against one side of framing gate 11 and a second set of shutter blades, shown as a pair of similar opposing shutter blades 16, is positioned against the other side of framing gate 11. The shutter blades in each pair are positioned oppositely to each other so that movement toward one another will cause the blades to block progressively larger portions of the framing gate opening 12. One set of shutter blades is rotated 90° from the other, as illustrated.

A set of slots 17 is provided in central support housing 10 on one side of framing gate 11, and a second set of slots 18 is provided on the other side of framing gate 11. Slots 17 are associated with shutter blades 15. Elongated necks **15*a* on shutter blades 15 extend through the slots, one neck per slot. Slots 18 are associated with shutter blades 16 with elongated shutter blade necks 16*a*** extending therethrough.

A pair of pressure plates 19 and 20 are provided, one on each side of framing gate 11. Shutter blades 15 are sandwiched between pressure plate 19 and framing gate 11. Shutter blades 16 are sandwiched between pressure plate 20 and framing gate 11. Pressure plate 19 is urged toward framing gate 11 by springs 21 mounted on central support housing 10 by bolts 22. Pressure plate 20 is similarly urged toward framing gate 11 by springs 23 mounted on housing 10 by bolts 24. The springs 21 and 23 are adapted to urge pressure plates 19 and 20 toward framing gate 11 with sufficient pressure to hold the shutter blades securely in position when no pressure is being applied to the shutter blade necks, but to allow the blades to move individually in response to any pressure applied to the necks. Handles 25 are attached to each shutter blade neck for convenience in moving a particular blade. It should be noted that the shutter blades are not attached or pivoted at any point to the framing gate or housing and therefor are substantially unrestricted in their movement within the respective spaces between such pressure plates and the framing gate that correspond to the thickness of the shutter blades.

Pressure plates 19 and 20 have central openings 26 and 27, respectively, therein, so that framing gate opening 12 is not blocked. Openings 25 and 26 are at least as large as framing gate opening 12, and may be larger.

Figure 3:
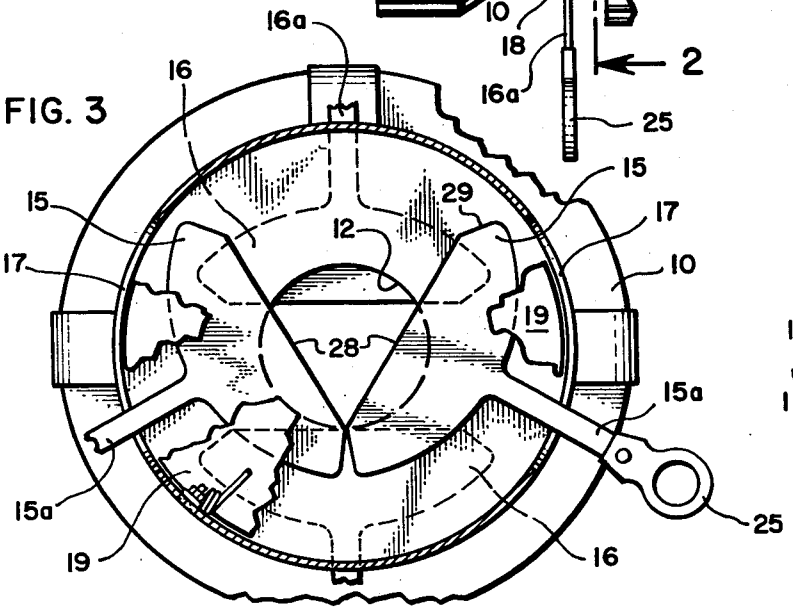

Necks 15*a* and 16*a* are preferably long enough to provide unrestricted travel of each blade so that each pair of blades may come together at the center of framing gate opening 12. Slots 17 and 18 are preferably long enough to provide a range of rotation to the blades. When using pairs of shutter blades as illustrated, it has been found that maximum flexibility in the arrangement of the shutter blades may be had if the slots are long enough to permit rotation of the blades through an arc of 82°. This allows blades of the configuration shown to form a triangle as illustrated in FIG. 3. In such a configuration, ends of one pair of shutter blades are brought together so that two sides of the triangle are formed by one set of blades and the third side is formed by one blade of the remaining set. The other blade is unused.

The shutter blades in the illustrated system each have a straight edge portion 28 that is adapted to be moved into and block a portion of the light beam passing through the framing gate opening 12. At the ends of straight portions 28 are short straight portions 29 sloped relative to the straight portion 28. This allows the ends of the blades to be brought together, such as shown in FIG. 3, increasing the range of positioning available, while still maintaining the shutter blades larger than the slots through which the neck portions extend so that they cannot be pulled directly out of the housing. With the blades rotated to some extent, the blades may still be pulled out, starting at one corner. It is therefor sometimes desirable to provide means to prevent removal of the blades through the slots. Also, it should be realized that various shapes and sizes of shutter blades may be used.

While the figures show each set of blades comprising a pair of blades, and this is presently preferred, it should be realized that more than two blades could be used in each set.

In the normal stage-lighting spotlight the beam of light passing through the framing gate opening contains a large amount of heat. Thus, when the shutter blades are positioned to block a portion of the light beam, they are subjected to heating which can sometimes be extreme. In prior art systems, shutter blades in a fully closed position have been measured at temperatures as high as 1150° F. This temperature is high enough to warp stainless steel and to melt aluminum.

With the system of the present invention, working temperatures of the blades will be between 250°–600° F. with maximum temperatures reached of about 650° F. This is significantly lower than in prior art systems.

The much lower working temperature of the blades is due to the intimate contact between the pressure plates, shutter blades, and framing gate, all of which are made of a good heat conducting material such as aluminum, so that heat is readily transferred away from the shutter blades. The central housing 10 and forward housing 14 are also made of a good heat conducting material such as aluminum so that they act as heat sinks drawing heat from the framing gate and shutter assembly. Forward housing 14 preferably has cooling fins 30 extending radially therefrom to increase cooling capacity of the system.

The lower working temperatures of the shutter blades allow the shutter blades to be made of materials other than stainless steel. The presently preferred material for the shutter blades is aluminum 2024 alloy. This alloy is ideal because hardening of the alloy takes place within the working temperature range of the shutter blades. Other aluminums tend to anneal in that temperature range so generally are unsuitable for use in the shutter blades. Any type of aluminum is generally usable for the pressure plates, framing gate, and housings since these parts are not subject to the temperatures that the shutter blades are. Their maximum temperatures would, at most, be in the lowest portion of the shutter blade working range.

An additional factor that adds to the lower working temperature range of the system of the invention when using aluminum shutter blades is that aluminum is a good infrared energy reflector which stainless steel is not. Therefore less of the infrared energy is absorbed by the aluminum blades.

The handles 25 attached to the shutter blade necks 15*a* and 16*a* are preferably made of a heat resistant material so that they remain relatively cool to facilitate blade adjustment.

Although the shutter system of the present invention can be advantageously used in any type of stage-lighting spotlight it is preferably used in conjunction with a stage-lighting spotlight which uses a reflector which provides a light beam of fairly uniform cross-sectional intensity. Such a reflector is described in my copending patent application Ser. No. 777,447, filed concurrently herewith. That reflector comprises a main reflector adapted to have a source of light placed along its central axis and having a central parabolic reflecting surface and an outer ellipsoidal reflecting surface, and a secondary reflector having an arcuate reflecting surface facing the reflecting surfaces of the main reflector and having an open central portion to allow light to pass therethrough.

The advantage of such a reflector is that since the infrared energy is distributed fairly uniformly over the cross-section of the light beam, it is distributed fairly evenly over the shutter blades that block such beam. This causes fairly uniform heating of the blades. With most conventional reflectors, the intensity of the light energy is concentrated in the central portion of the beam which causes very uneven heating of the shutter blades.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A shutter system for stage-lighting spotlights comprising a housing; a fixed framing gate in said housing having an opening therein for the passage of light; two sets of opposing slots in said housing, one set located on each side of said framing gate; two sets of opposing shutter blades, each set of blades being associated with a set of slots and each shutter blade having a neck portion thereof extending through one of the slots of its associated set of slots and being adapted to be moved into or out of the open portion of said framing gate to restrict to any desired degree the size of the opening through which light passes; two pressure plates, one on each side of said framing gate and each having a central opening corresponding to said opening in the framing gate, each set of shutter blades being sandwiched between a pressure plate and said framing gate so as to hold the respective pressure plates separated from the framing gate by spaces corresponding to the thickness of a shutter blade; and means located completely outside of said spaces for resiliently and constantly urging the pressure plates toward said framing gate so that the shutter blades are held securely in place between the pressure plate and framing gate but are movable under force applied to the blades.

2. A shutter system according to claim 1, wherein each set of shutter blades comprises two opposing shutter blades; and each set of slots comprises two opposing slots.

3. A shutter system according to claim 2, wherein the slots extend a sufficient distance so that the neck of each blade may be moved through an arc of 82°.

4. A shutter system according to claim 2, wherein each shutter blade has a flat edge opposite the side from which the neck extends, the flat edge being adapted to be moved into and out of the open portion of the framing gate.

5. A shutter system according to claim 1, wherein the necks on the shutter blades extend through the slots a sufficient distance to act as handles for applying force to cause movement of the blades.

6. A shutter system according to claim 5, wherein handles of a heat resistant material are attached to the neck portions of the blades to provide handles for moving the blades that remain cool to the touch.

7. A shutter system according to claim 1 wherein the shutter blades, the framing gate, the pressure plates, and at least a portion of the housing are made of heat conducting material so that they act as heat sink surfaces.

8. A shutter system according to claim 7, wherein the heat conducting material is aluminum.

9. A shutter system according to claim 8, wherein the shutter blades are made of aluminum 2024 alloy.

10. A shutter system according to claim 1, wherein the shutter blades are made of aluminum 2024 alloy.

* * * * *